US006612742B1

(12) United States Patent
Carter

(10) Patent No.: US 6,612,742 B1
(45) Date of Patent: Sep. 2, 2003

(54) INSULATED CONTAINER WITH INTERNAL HARNESS

(76) Inventor: James E. Carter, 213 Corbet St., Tarentum, PA (US) 15084

( * ) Notice: Subject to any disclaimer, the term of this patent is extended or adjusted under 35 U.S.C. 154(b) by 0 days.

(21) Appl. No.: 10/033,062

(22) Filed: Oct. 25, 2001

Related U.S. Application Data

(63) Continuation-in-part of application No. 09/875,309, filed on Jun. 6, 2001, now abandoned.

(51) Int. Cl.[7] ..... B65D 30/10
(52) U.S. Cl. ..... 383/110; 383/18; 220/592.19
(58) Field of Search ..... 383/18, 19, 110, 383/121, 903; 220/592.19

(56) References Cited

U.S. PATENT DOCUMENTS

| | | | | |
|---|---|---|---|---|
| 616,249 A | | 12/1898 | Nickerson | |
| 1,289,920 A | * | 12/1918 | Rottman | 383/18 |
| 1,428,617 A | * | 9/1922 | Thaw | 383/18 |
| 1,696,085 A | | 12/1928 | Gibson | |
| 1,729,318 A | | 9/1929 | Wunderlich | |
| 1,904,729 A | | 4/1933 | Hancock | |
| 2,101,459 A | * | 12/1937 | Satz | 190/115 |
| 3,185,198 A | * | 5/1965 | Bryan | 383/6 |
| 3,980,216 A | * | 9/1976 | Nye | 220/592.2 |
| 4,224,970 A | | 9/1980 | Williamson | |
| 4,390,051 A | | 6/1983 | Cuthbertson | |
| 4,395,067 A | | 7/1983 | Robin | |
| 4,449,655 A | * | 5/1984 | Germe | 224/153 |
| 4,457,456 A | | 7/1984 | Derby | |
| 4,513,895 A | * | 4/1985 | Leslie | 224/153 |
| 4,514,993 A | * | 5/1985 | Johnson | 62/372 |
| 4,679,242 A | | 7/1987 | Brockhaus | |
| 4,703,517 A | | 10/1987 | Marino | |
| 4,707,969 A | * | 11/1987 | Marino | 53/449 |
| 4,714,143 A | * | 12/1987 | Saliba | 190/115 |
| 4,730,942 A | | 3/1988 | Fulcher | |
| 4,759,077 A | | 7/1988 | Leslie | |
| 4,802,344 A | * | 2/1989 | Livingston et al. | 62/372 |
| 4,863,284 A | * | 9/1989 | Cheng | 383/18 |
| 5,127,536 A | | 7/1992 | Cohen | |
| 5,248,429 A | * | 9/1993 | Larsen | 210/767 |
| 5,251,460 A | * | 10/1993 | DeMarco et al. | 220/592.19 |
| 5,361,605 A | * | 11/1994 | Pizzi et al. | 220/903 |
| 5,518,315 A | | 5/1996 | Nichols | |
| 5,564,568 A | * | 10/1996 | Rankin, Sr. | 220/592.19 |
| 5,988,879 A | | 11/1999 | Bredderman | |

FOREIGN PATENT DOCUMENTS

| | | | | |
|---|---|---|---|---|
| CA | 2320062 A1 | | 3/2001 | |
| GB | 1071296 | * | 6/1967 | 383/18 |

* cited by examiner

*Primary Examiner*—Jes F. Pascua
(74) *Attorney, Agent, or Firm*—Jones, Tullar - Cooper, P.C.

(57) ABSTRACT

An insulated beer-keg container having a freely hanging, or suspended, internal harness. The length of the harness is chosen independently of the lengths of the remaining materials of the container and sufficiently shorter than the lengths of those materials that there is no loading of the materials when a keg is carried within the container by handles connected to the harness.

5 Claims, 9 Drawing Sheets

INSULATED CONTAINER WITH INTERNAL HARNESS

CROSS-REFERENCE TO RELATED APPLICATION

This is a continuation-in-part of my U.S. patent application Ser. No. 09/875,309 bearing the same title and filed Jun. 6, 2000 now abandoned.

TECHNICAL FIELD

This invention relates to improvements to insulated containers for beer kegs.

1. Background Art

U.S. Pat. No. 4,759,077 discloses an insulated container for beer kegs. A harness is built into the wall of the container and sewn to its handles, in an attempt to shield parts of the container from the weight of a beer keg.

2. Disclosure of Invention

It is an object of the invention to provide insulated, beer-keg containers with improved harness installations.

This as well as other objects of the invention are achieved in a first version of an insulated container of the invention by locating a harness freely hanging inwards of the wall of the container from handles of the container. The length of the harness can then be chosen independently of the lengths of the materials of the wall of the container and sufficiently shorter than the lengths of those materials that there is no loading of the materials by the weight of the keg when a keg is carried within the container.

In contrast, the harness of the above-referenced U.S. Pat. No. 4,759,077 is sandwiched within the wall of the container. That construction places a disadvantageous constraint on the harness, that the length of its members must be very close to the corresponding lengths of the materials between which it is sandwiched. A consequence of such constraint is that the presence of the harness may, in fact, have no effect at all in unloading the materials of the container. This can happen, for instance, if there is more stretch in the harness material than in the material of the container. Certainly, inner liner 10 of the patent always gets loaded by the keg. And, the patent itself appears to recognize that there will at least still be some sharing of the load onto outer jacket 13. Thus, it states, at its column 4, line 5, that "the weight will not bear entirely upon the bottom panel 27 of the jacket".

Experience with the first version of the insulated container of the invention has led to an improved, second version. Thus, beer kegs are very heavy, and users experience difficulty in lifting a keg to then insert it from above into an insulated container. To make insertion easier, a new method of the invention is provided, and this, in turn, is made more successful by a new, second version of insulated container.

The method involves first turning the heavy keg upside down on a floor or the ground. Then, the light, insulated container is easily pulled down, over the keg. Following this, the resulting assembly is turned back, upside up.

When the first version of the invention is tried with this new method, a disadvantage is experienced in that the freely hanging harness falls out of the container when the container is turned upside down. This makes it difficult or practically impossible to end with the harness properly arranged on the keg when assembly of the container with the keg is completed.

According to a second version of the invention, the harness is suspended within the container, rather than allowed to hang freely, so that, when the container is turned upside down, the harness stays sufficiently in position relative to the container that it ends up properly arranged on the keg when assembly of the container with the keg by the method of the invention is finished. Structurally, this is accomplished by suspending the harness within the container from handles of the container and, deeper within the container, from the wall of the container.

As in the first version, in the second version also, the length of the harness is chosen independently of the lengths of the materials of the wall of the container and sufficiently shorter than the lengths of those materials that there is no loading of the materials by the weight of the keg when a keg is carried within the container.

BRIEF DESCRIPTION OF THE DRAWING

The same part of the invention appearing in more than one view is designated by the same reference numeral.

MODES OF THE INVENTION

Figure 1:
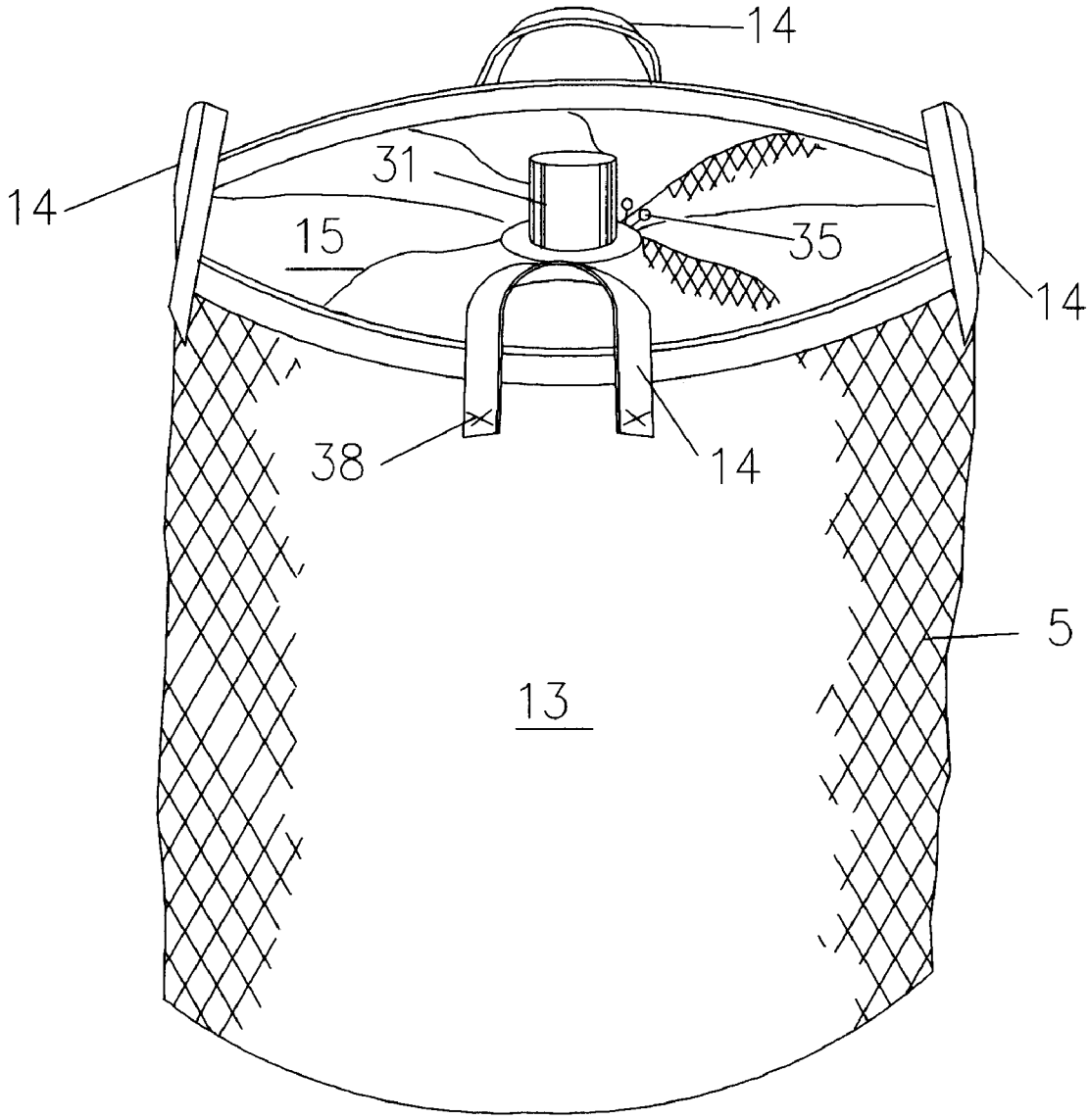
FIG. 1 is a perspective view of an embodiment of the container of the invention shown in operative association with a beer keg.
Figure 2:
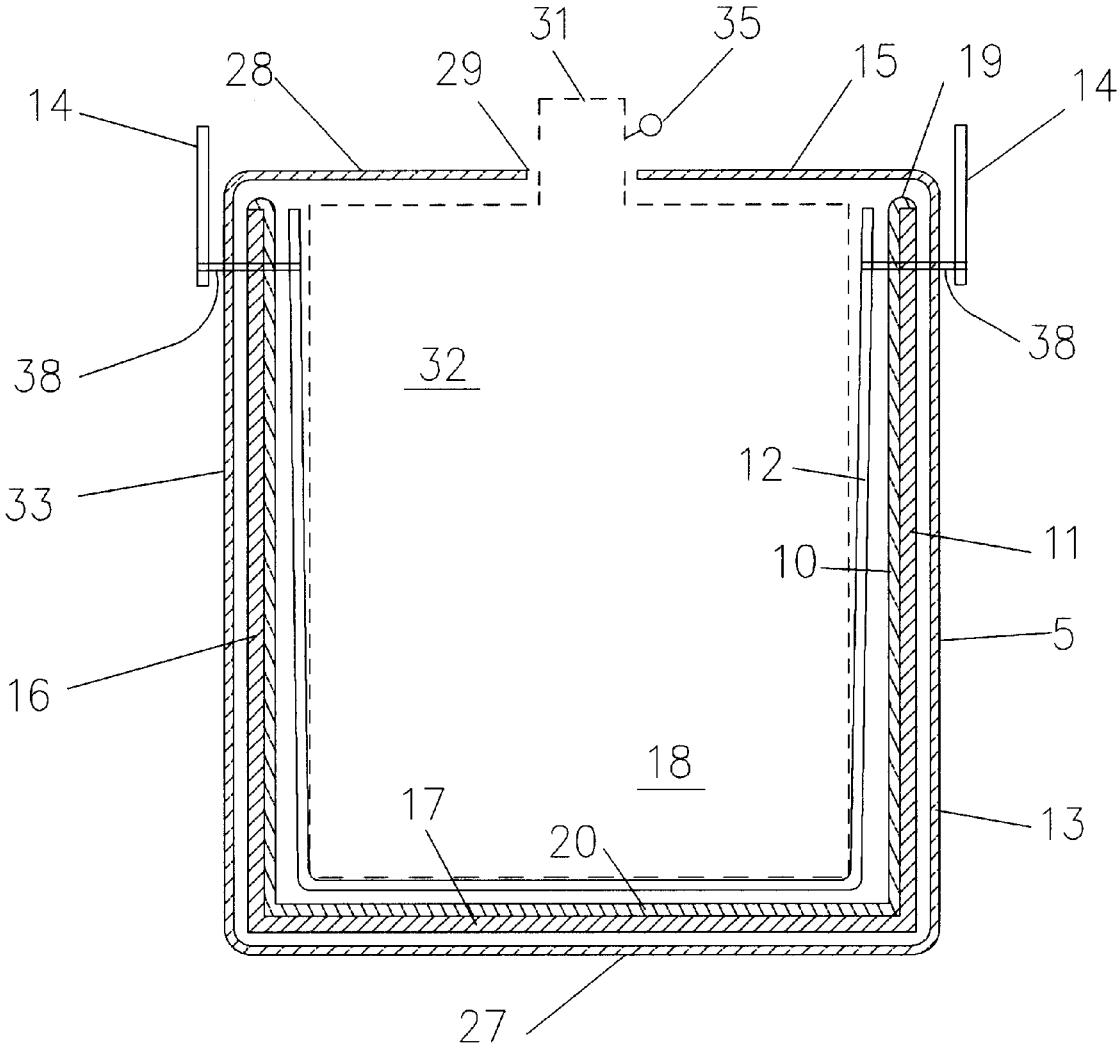
FIG. 2 is a vertical sectional view of the container of FIG. 1.
Figure 3:
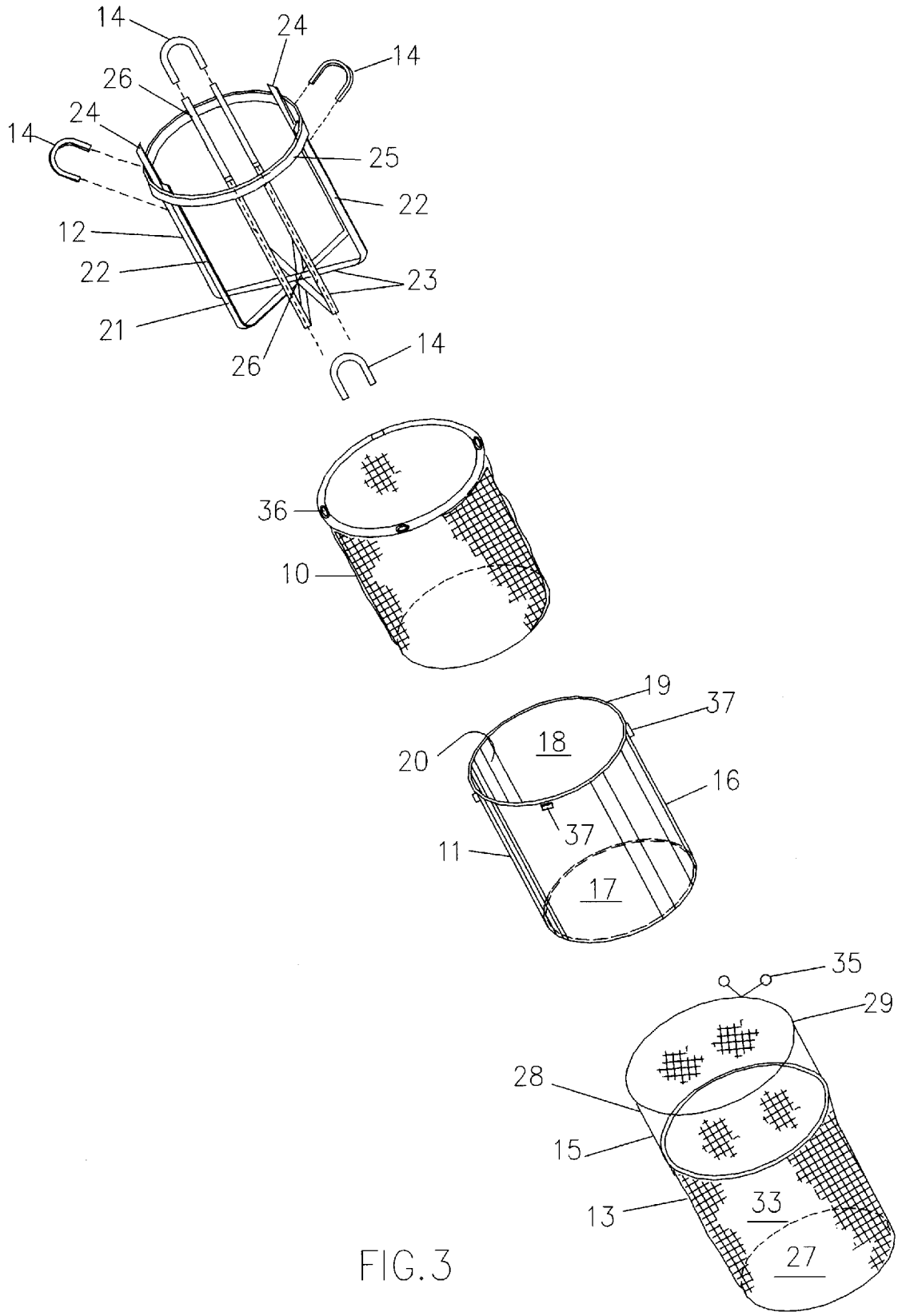
FIG. 3 is an exploded view of the container of FIG. 1.

FIGS. 1–3, particularly FIGS. 2 and 3, are modified from FIGS. 1–3 of the above-referenced U.S. Pat. No. 4,759,077. The same numbering system used there is used here, and the entire disclosure of U.S. Pat. No. 4,759,077 is incorporated here by reference, for the purpose of explaining features not expressly mentioned here.

Fundamentally, the insulated container of the present invention and that of U.S. Pat. No. 4,759,077 are both comprised of an insulated wall, handles, and a harness.

FIGS. 1–3 show the first version of the insulated container of the invention, insulated container 5, where the harness is freely hanging.

As shown in FIG. 2, harness 12 is innermost in the present invention and, in the first version, hangs freely inwards of the wall (liner 10, shell 11 and jacket 13) of the insulated container from its attachment by stitching 38 to handles 14. The various parts (liner 10, shell 11, harness 12, jacket 13, and handles 14) of the container are shown spaced from one another at stitching 38 for purposes of illustration only. Thus, in actual practice, they are tightly bound together by stitching 38. The length of harness 12, from the stitching 38 on the left in FIG. 2, down around the bottom of beer keg 32, and up to the stitching 38 on the right, is chosen sufficiently shorter than the corresponding lengths of liner 10, shell 11, jacket 13 such that, when the handles 14 are grasped to carry the container with the keg inside, preferably all of the weight of the keg is borne by the harness and handles, and no weight of the keg bears at the bottom of the keg against the container wall built of liner 10, shell 11, and jacket 13. All the weight of the keg is transmitted directly from harness 12 into handles 14. During carrying of the container with a keg inside, the wall of the container, i.e. liner 10, shell 11, and jacket 13, simply hangs from the junctions at stitching 38. The wall does not bear any of the weight of the keg and does not transmit any of the weight of the keg to handles 14.

As a result of the different arrangement of harness 12 in this invention, harness 12 is first in line in the exploded view of FIG. 3, as compared to FIG. 3 of U.S. Pat. No. 4,759,077.

While the connections at harness strap crossing 26 can be stitchings, such as stitching 38, they may as well be riveted connections. And, while the illustrated embodiment applies four straps and four handles, two straps and two handles may be omitted, so that only two opposed handles remain, with the straps crossing and being connected together at the bottom of the container. It is even possible to use a harness composed of only one strap connected to two opposed handles, in which case the handles are each looped back on themselves to single, opposed locations of stitching 38.

Figure 4:
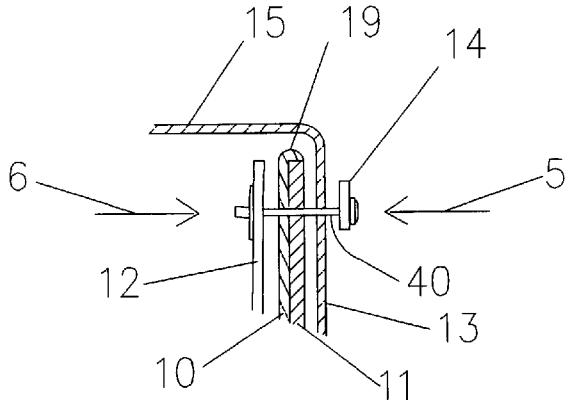
FIG. 4 is a view as in FIG. 2 of an alternative embodiment of the container of the invention.
Figure 5:
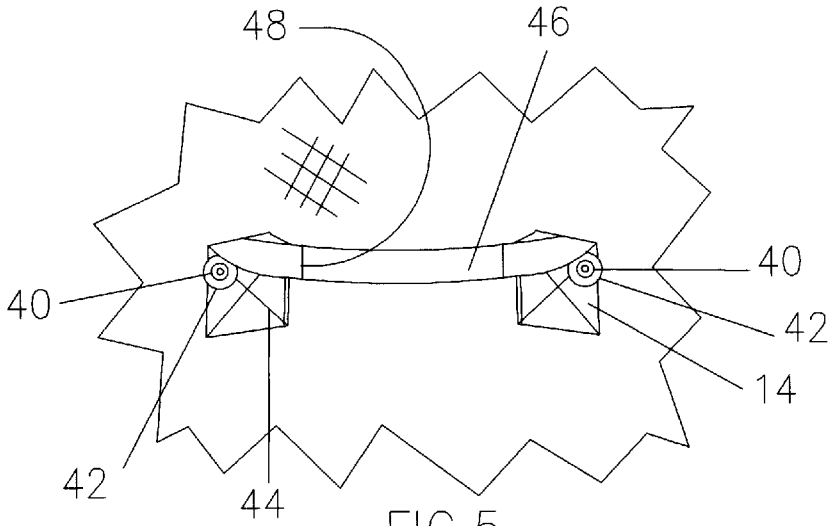
FIGS. 5 and 6 are elevational views taken onto the container of FIG. 4 in the directions of arrows 5 and 6, respectively, of FIG. 4.
Figure 6:
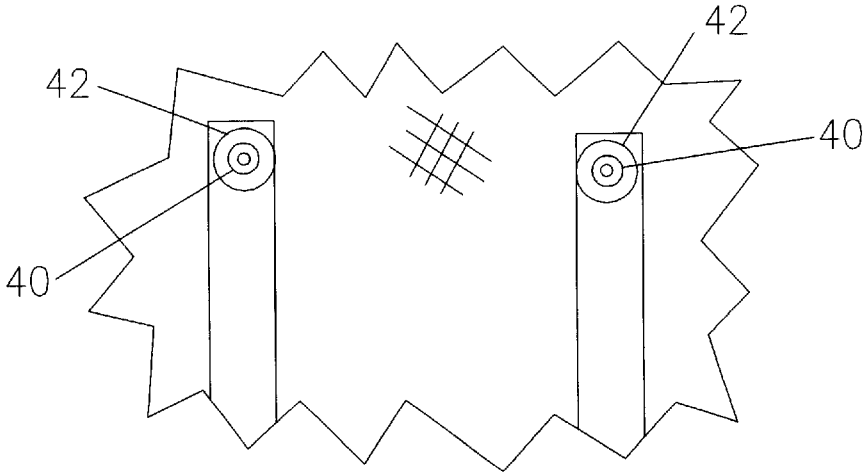

FIGS. 4–6 illustrate an embodiment of the invention where rivets 40 are used in place of stitching 38. Rivets 40 may be blind POP-brand rivets, having a rivet body and a setting mandrel, from Emhart Fastening Teknologies, Shelton, Conn., as described at www.emhart.com/products/pop.html.

Analogously to FIG. 2, the various parts (liner 10, shell 11, harness 12, jacket 13, and handles 14) of the container are shown in FIG. 4 spaced from one another at rivets 40 for purposes of illustration only. Thus, in actual practice, they are tightly bound together by the rivets.

In order that the rivets not pull through the fabric materials when the rivets are being set, washers 42 are placed on the shanks of the rivets, and, when the rivets are set, press against, respectively, handles 14 on the outside of the container and the straps of harness 12 on the inside of the container. The presence of the washers causes a distributing, or spreading, of the forces, which lowers the maximum stresses through the handle-to-harness junctions, as compared to the more concentrated loading that would result from the narrower rivets alone.

For sake of neatness of manufacture, the handles 14 are tied to jacket 13 by stitching 44, but the load of the keg is transmitted from harness 12 through the riveted junctions into the gripping portions 46 of the handles 14. The straps from which handles 14 are made are folded in half in the area of the gripping portions and held folded by stitching, for instance stitching 48, for wear resistance. As in the case of the embodiment of FIG. 2, in the embodiment of FIG. 4, during carrying of the container with a keg inside, the wall of the container, i.e. liner 10, shell 11, and jacket 13, simply hangs, without bearing any of the weight of the keg, from the junctions at rivets 40.

Figure 7:
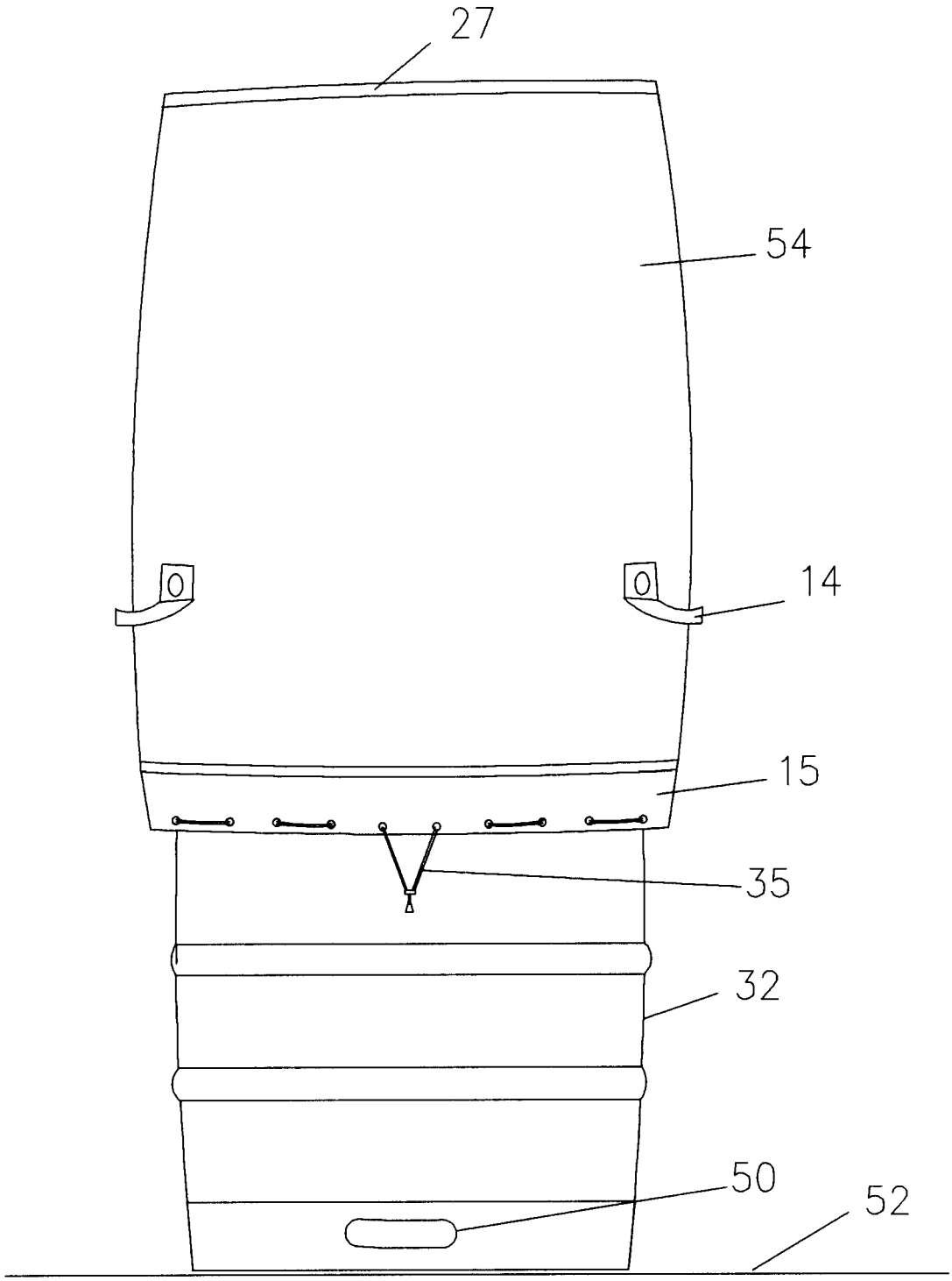
FIG. 7 is an elevational view illustrating a method of the invention.

FIG. 7 illustrates the new method of the invention, where a beer keg 32 has been turned upside down, as indicated by the keg handle 50 being by floor 52, and an insulated container 54 built according to the second version of the invention is being pulled down, onto the keg. The pulling down may be accomplished by hands (not shown) applied to handles 14 or to top closure 15. Once closure 15 reaches floor 52, the assembled unit of keg and insulated container is then turned upside up, where bottom panel 27 is then on the floor.

Figure 8:
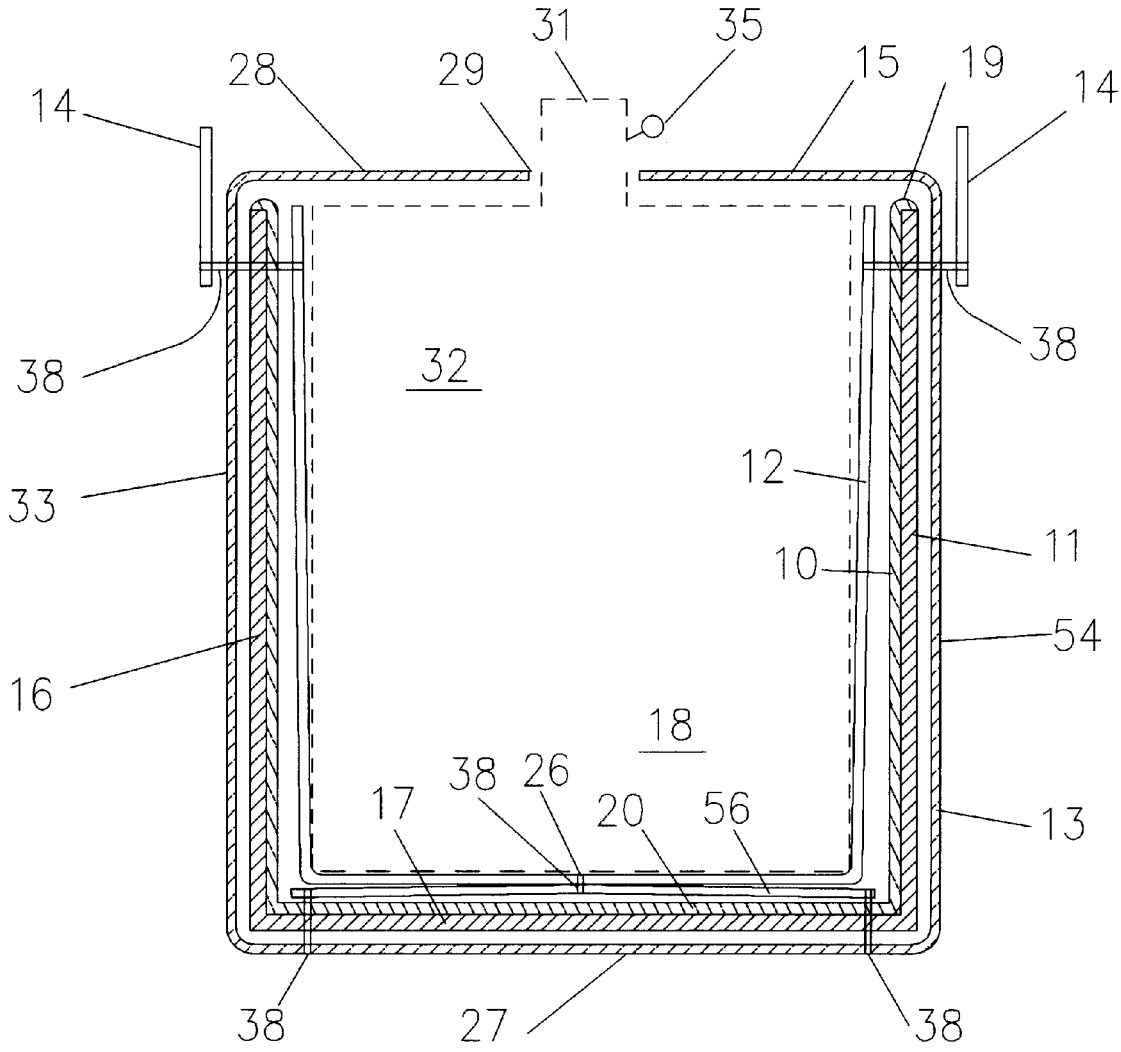
FIGS. 8 and 12 are views as in FIG. 2 of modified forms of the container of the invention.
Figure 9:
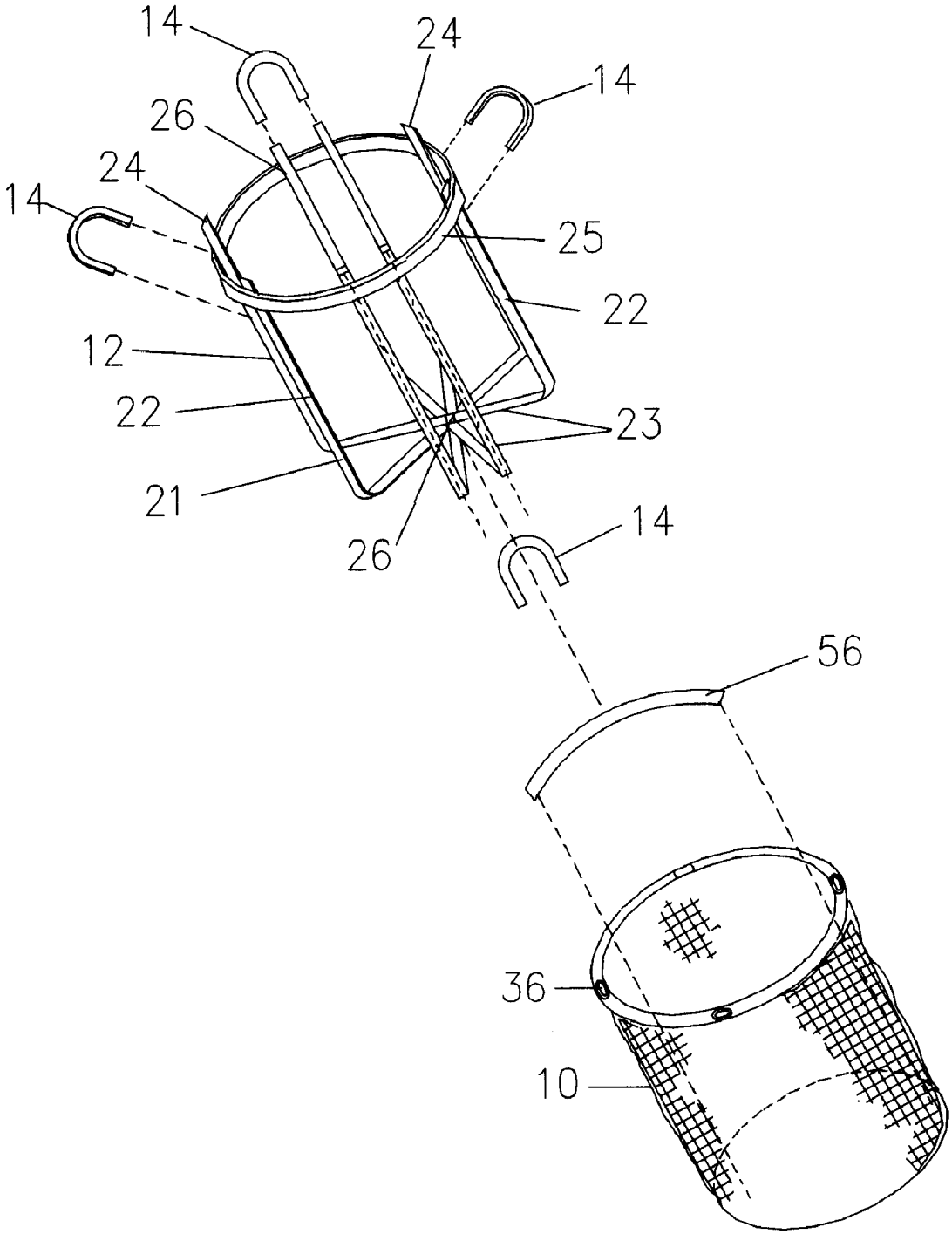
FIG. 9 is an exploded view of a portion of the container of FIG. 8.

FIGS. 8 and 9 show details of an insulated container 54 built according to the second version of the invention. This second version differs from the first version illustrated in the corresponding FIGS. 2 and 3 by provision of means to suspend harness 12 within the container, rather than let it hang freely, as in FIGS. 2 and 3. This type of securement of the harness is achieved, for example, by supplying, in addition to the connection of the harness to the handles 14, a suspension strap 56 connecting the harness to the container wall deeper within the container than the handles 14 connection. As shown in FIG. 8 and by the dashed lines in FIG. 9, the ends of strap 56 are tied to the wall of the container by stitching 38 at opposing points by the perimeter of the bottom panel of the wall and the center of strap 56 is tied to the harness by stitching at crossing 26. Thus stitched, strap 56 keeps harness 12 sufficiently in place, even if the container is turned upside down, that a symmetric arrangement of the harness on a keg is easily achieved when practicing the method of FIG. 7. Rivets and washers may be used in place of stitching for securing strap 56.

While the concept of a freely hanging, or suspended, internal harness has been disclosed here in the context of an insulated container as disclosed in U.S. Pat. No. 4,759,077, it may analogously be applied to an insulated container of the type disclosed in my U.S. patent application Ser. No. 09/659,792, filed Sep. 12, 2000, incorporated here by reference. The insulated container of my Application Ser. No. 09/659,792 differs from that in U.S. Pat. No. 4,759,077, in that my container is intended to be used without ice. Instead, the keg and its beer are initially well cooled, and the insulation of my container is then used to resist movement of heat from the surroundings into the beer. The disclosure of my application Ser. No. 09/659,792 is also contained in my Canadian Patent Application No. 2,320,062, laid open on Mar. 20, 2001.

Figure 10:
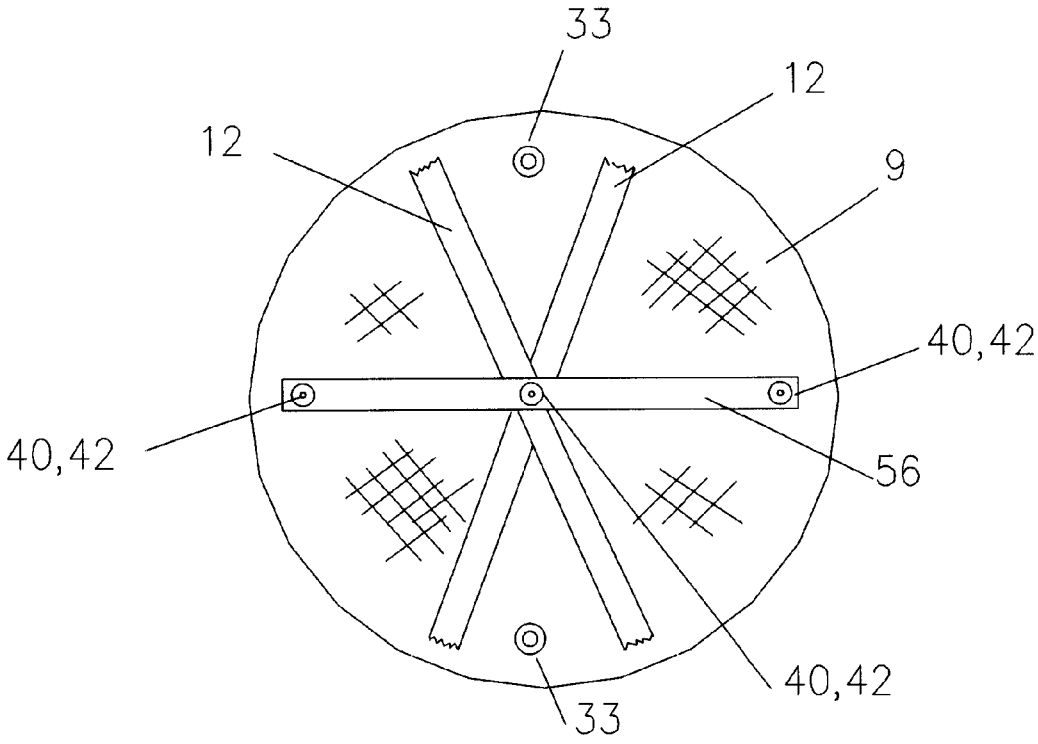
FIGS. 10 and 11 are, respectively, views from above and below of the floor of an iceless container modified as in FIG. 8.
Figure 11:
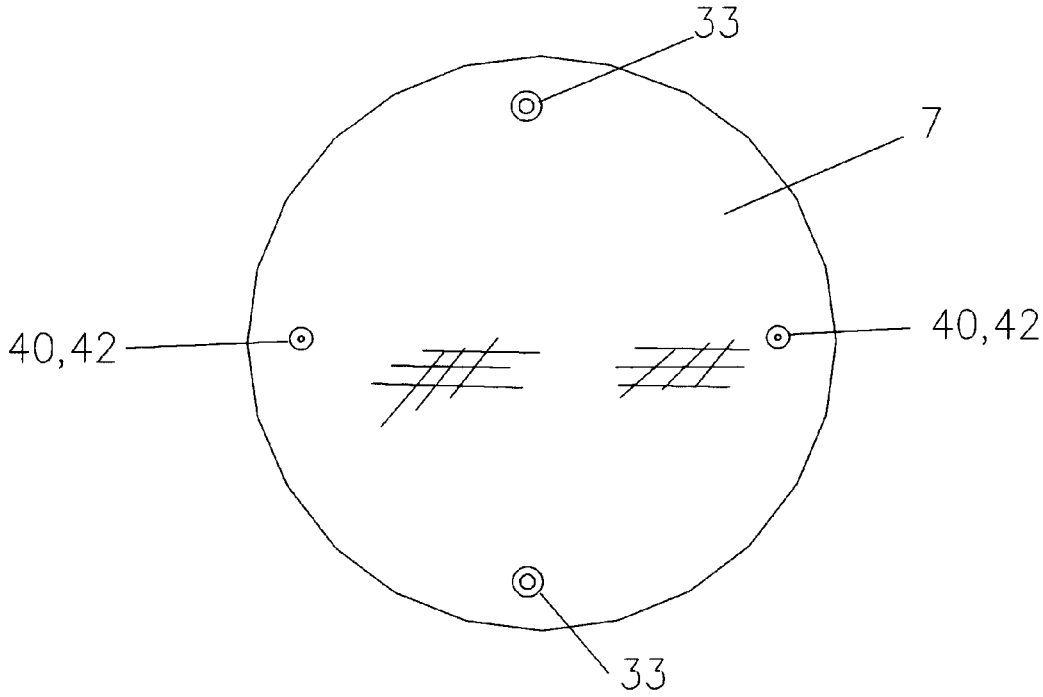

FIGS. 10 and 11 show a suspension strap 56 associated with the bottom panel of the insulated wall of an iceless container of the type disclosed in my application Ser. No. 09/659,792. Connections are made with rivet, washer combinations 40,42, instead of stitching. Grommets 33 provide for airflow, as explained in application Ser. No. 09/659,792. The container has only two handles, so that only two straps are used for harness 12.

Figure 12:
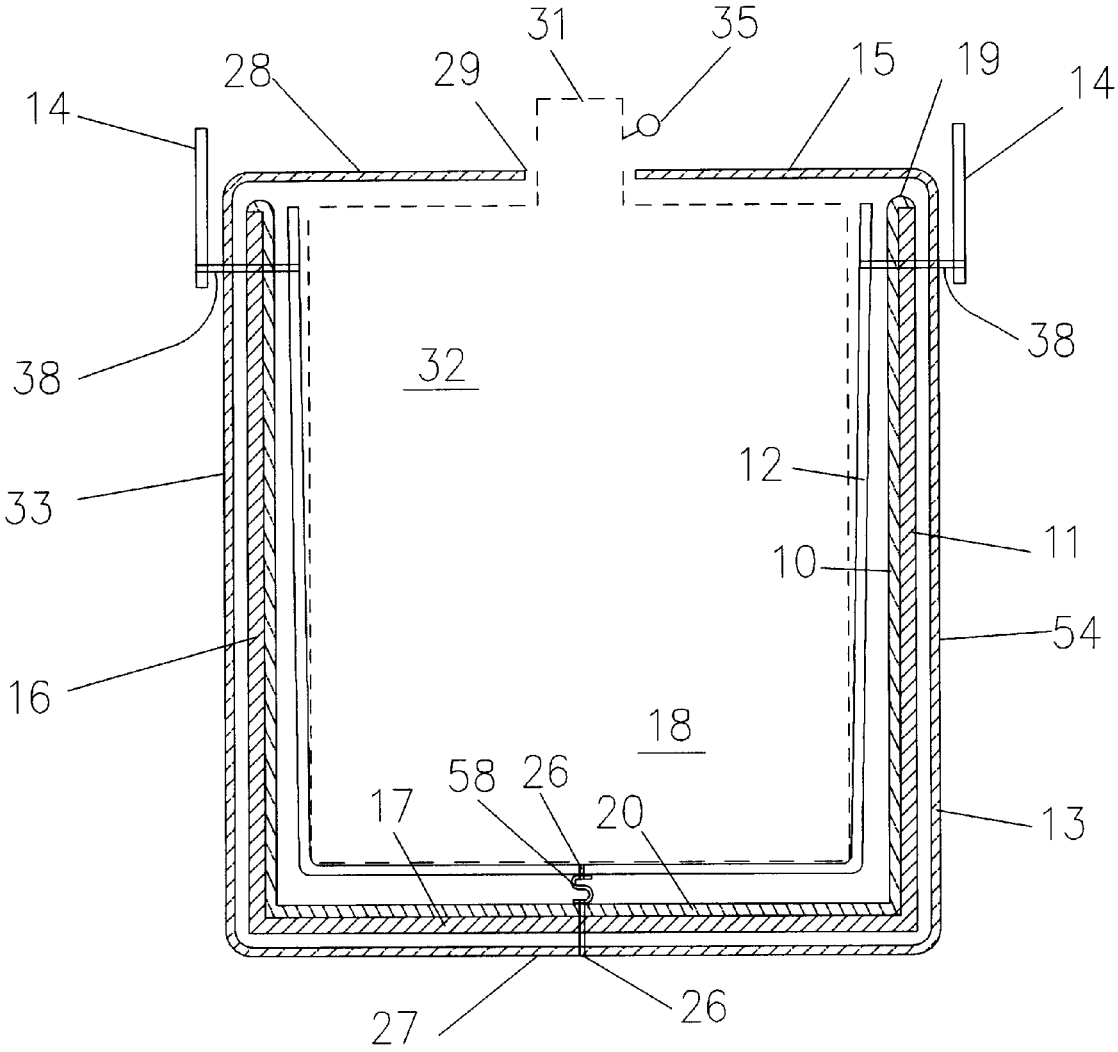

FIG. 12 shows a suspension strap 58 connecting crossing 26 with the middle of the bottom panel of the container wall.

In the views of FIGS. 8 and 12, it can be seen that strap 56 has a tent-shape, while strap 58 has an S-shape. These shapes are used to accomodate the gap between the beer keg and the bottom panel of the container wall, and the gap between crossing 26 and the bottom panel, when the container is lifted by the handles 14. A C-shape would also work for strap 58. It is recognized that crossing 26 could also be tied directly to the middle of the bottom panel, i.e. strap 58 eliminated, in which case the bottom panel would dimple upwards during lifting of the container with a keg in it. All of these means of suspending the harness from the wall of the container constrain crossing 26 to remain by the middle of the bottom panel of the wall, when the container is turned upside down for performing the method of FIG. 7.

Important to the feasibility of the modification of U.S. Pat. No. 4,759,077 represented by the present invention is the recognition that a beer keg is a rigid, monolithic, or at least rigidly integrated, object. Thus, if the container of this invention were applied for carrying a granular substance, such as grain, or a liquid, the grain or liquid would flow around the harness and load the materials of the container despite the harness.

There follows, now, the claims. It is to be understood that the above are merely preferred modes of carrying-out the invention and that various changes and alterations can be made without departing from the spirit and broader aspects of the invention as defined by the claims set forth below and by the range of equivalency allowed by law.

What is claimed is:

1. A container for a beer keg, comprising an insulated wall, handles, and a harness, the harness suspended inwards of the wall from the handles and, deeper within the container, from the wall, so that the harness cannot fall out of the container when the container is turned upside down, the harness having a length such that during carrying by the handles a keg's entire weight is transmitted from the harness into the handles, wherein the harness is joined to the handles at junctions by rivets, and wherein the junctions contain washer means for spreading forces through the junctions.

2. A container for a beer keg, comprising an insulated wall, handles, and a harness, the harness suspended inwards of the wall from the handles and, deeper within the container, from the wall, to create a suspending from the wall, so that the harness cannot fall out of the container when the container is turned upside down, the suspending from the wall constraining a crossing (26) of the harness to remain centered on a bottom panel of the wall, when the container is turned upside down.

3. A container as claimed in claim 2, further comprising a suspension strap having a center and two ends, the bottom panel having a perimeter, the center tied to the crossing (26) and the ends to opposing points by the perimeter.

4. A container for a beer keg, comprising an insulated wall, handles, and a harness, the harness suspended inwards of the wall from the handles and, deeper within the container, from the wall, to create a suspending from the wall, so that the harness cannot fall out of the container when the container is turned upside down, the suspending from the wall constraining a crossing (26) of the harness to remain by a middle of a bottom panel of the wall, when the container is turned upside down, the suspending from the wall allowing a gap between the crossing (26) and the bottom panel, when the container is lifted by the handles.

5. A container as claimed in claim 4, the suspending from the wall comprising a shaped strap.

* * * * *